US011957228B2

(12) United States Patent
Smith et al.

(10) Patent No.: US 11,957,228 B2
(45) Date of Patent: Apr. 16, 2024

(54) HAND-HELD HAIR REMOVAL ARTICLE

(71) Applicants: Benjamin J. Smith, Providence, UT (US); Emily Smith, Providence, UT (US); Courtney Smith, North Logan, UT (US)

(72) Inventors: Benjamin J. Smith, Providence, UT (US); Emily Smith, Providence, UT (US); Courtney Smith, North Logan, UT (US)

( * ) Notice: Subject to any disclaimer, the term of this patent is extended or adjusted under 35 U.S.C. 154(b) by 0 days.

(21) Appl. No.: 18/049,389

(22) Filed: Oct. 25, 2022

(65) Prior Publication Data

US 2023/0147326 A1 May 11, 2023

Related U.S. Application Data

(60) Provisional application No. 63/263,938, filed on Nov. 11, 2021.

(51) Int. Cl.
*A45D 26/00* (2006.01)

(52) U.S. Cl.
CPC ..... *A45D 26/0014* (2013.01)

(58) Field of Classification Search
CPC ..... A45D 26/0014; A45D 2026/008; A45D 44/22; A61F 13/00; A61F 2013/00089; A61F 7/03; B05B 12/24; A61M 5/44; A61M 25/02; A61K 8/676; A61B 19/24
See application file for complete search history.

(56) References Cited

U.S. PATENT DOCUMENTS

2007/0269469 A1* 11/2007 Hall-Maxwell .... A45D 26/0004 424/401
2010/0161014 A1* 6/2010 Lynch ..... A61F 7/02 607/108
2014/0295188 A1* 10/2014 Ludtke ..... C09D 5/20 428/521
2019/0000207 A1* 1/2019 Jones ..... A45D 26/0019
2020/0405032 A1* 12/2020 Stack ..... A45D 26/0019

* cited by examiner

*Primary Examiner* — Mohamed G Gabr
*Assistant Examiner* — Aman Kumar Mann
(74) *Attorney, Agent, or Firm* — Block45 Legal LLC; Mark Emde

(57) ABSTRACT

The present invention relates in general to a hand-held hair removal article. More specifically, the invention relates to a shaped flexible article adapted to scoop a hair removal compound, apply the hair removal compound to a hair removal area, and remove the hair removal compound and hair from the hair removal area.

1 Claim, 4 Drawing Sheets

HAND-HELD HAIR REMOVAL ARTICLE

FIELD OF THE INVENTION

The present invention relates to a hand-held hair removal article. More specifically, the invention relates to a shaped flexible article adapted to scoop a hair removal compound, apply the hair removal compound to a hair removal area, and remove the hair removal compound and hair from the hair removal area.

RELATED PATENT APPLICATION

The present application is related to co-pending U.S. provisional patent application for HAND-HELD HAIR REMOVAL ARTICLE, application No. 63/263,938, filed Nov. 11, 2021, the full disclosures of which are hereby incorporated by reference and priority which are hereby claimed.

BACKGROUND

Hair removal wax systems are well known in the art and have been utilized for many years. Such systems suffer from a number of deficiencies. The typical process involves locating a target hair removal location, heating a desired amount of wax, and applying it to the target hair removal location, allowing the wax to start cooling from the resultant skin contact, allowing the hair to bond with the cooling wax, applying a disposable strip to the wax and hair bond, and then lifting or ripping the disposable strip, removing the wax and hair bond, leaving hairless, smooth skin. Because the root of the hair is typically removed from the follicle, growth of hair above the skin surface will typically take several days to several weeks. This prolonged period of lack of exposed hair is desirable both for the non-prickly feeling and for the hairless aspects. Drawbacks of such systems are fairly well known. First, removal strips must be purchased in quantity to allow for reapplications. As a result, unwanted cost and storage are needed. Additionally, storage of the strips can be messy, unsightly, and inconvenient, to the extent that storage with the wax is not desired, it is easy to lose one or both of the wax and strips leading to further displeasure with the system. Finally, removal strips are not always environmentally friendly and are typically disposable and not reusable.

Another system for hair wax removal comprises a sugar based natural wax that can be applied to a target hair removal area. Most of the sugar based natural wax hair removal methods comprise that of traditional wax application and removal processes, wherein the wax is heated, applied on the skin, and removed with either wax strips or by hand, pulling the wax away from the skin and removing the hair. Some sugar based natural wax systems exist such that the sugar based natural wax can be warmed on contact with the user's skin to bond with the hair to be removed and then quickly removed from the skin to remove not only the hair removal compound, but also hair which has bonded thereto. The hair removal system sometimes includes a volume of hair removal compound configured to bond with hair upon application to the user's skin and the use of a hand or a reusable flexible member adapted to scoop, apply and/or remove the volume of hair removal compound from a hair removal area. Drawbacks of such reusable flexible members are fairly well known, including, but not limited to, improper and/or inefficient shape, non-ergonomically conscious designs, improper material such as polyvinyl chloride that can break and cause injury to the user, designs that allow for slippage during use, and a steep learning curve in learning to properly use the reusable flexible member, wherein improper techniques can lead to bruising and extensive hair removal time. Further drawbacks exist based on current designs of reusable flexible members that are uniform in shape and some consisting of a more rectangular nature, creating difficulty for the user in accessing hard to reach parts of the body, namely the bikini area where the upper leg meets the joints of the pelvis, the bikini area under the body, or the buttocks. Thus, there is a need in the art for a hand-held hair removal article with improved functionality, performance, and design.

BRIEF DESCRIPTION OF THE DRAWINGS

The accompanying drawings form a part of the specification and are to be read in conjunction therewith, in which like reference numerals are employed to indicate like or similar parts in the various views.

DETAILED DESCRIPTION

Figure 1:
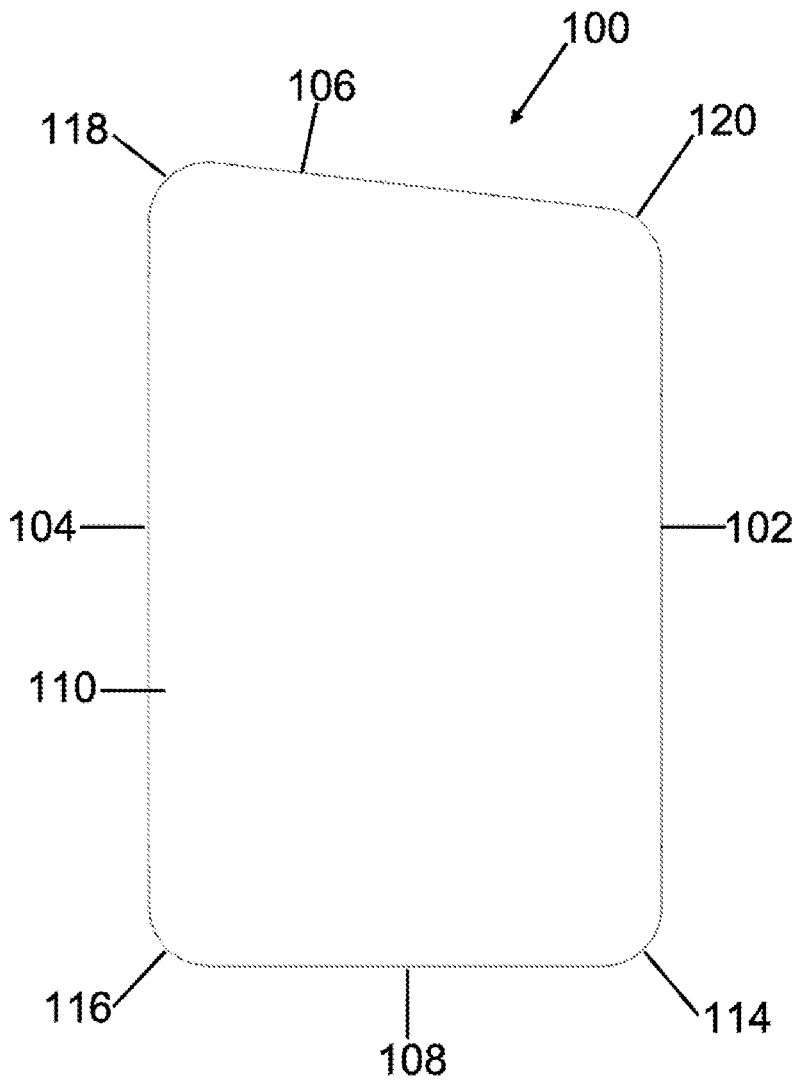
FIG. 1 is a plan view of one embodiment of a hand-held hair removal article in accordance with the teachings of the present disclosure.
Figure 2:
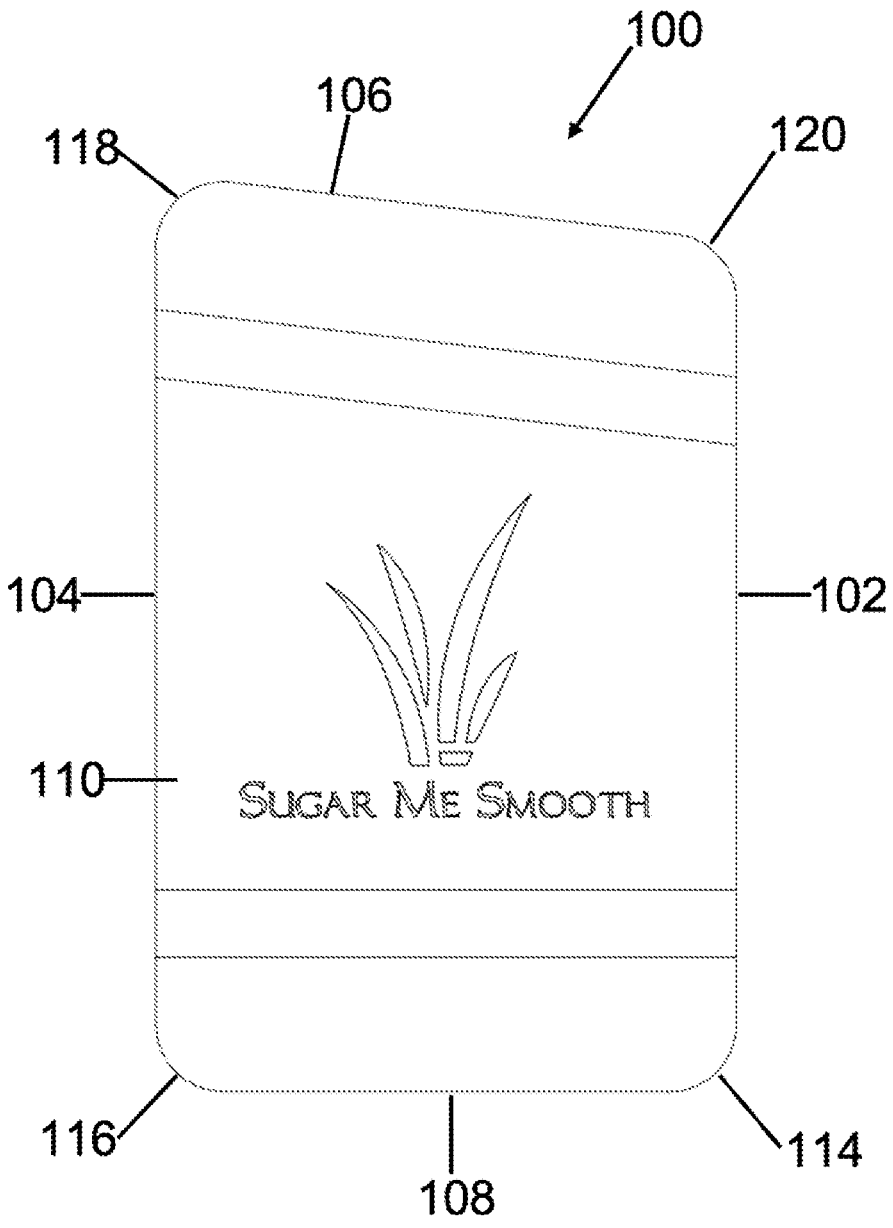
FIG. 2 is a plan view of one embodiment of a hand-held hair removal article in accordance with the teachings of the present disclosure.
Figure 3:
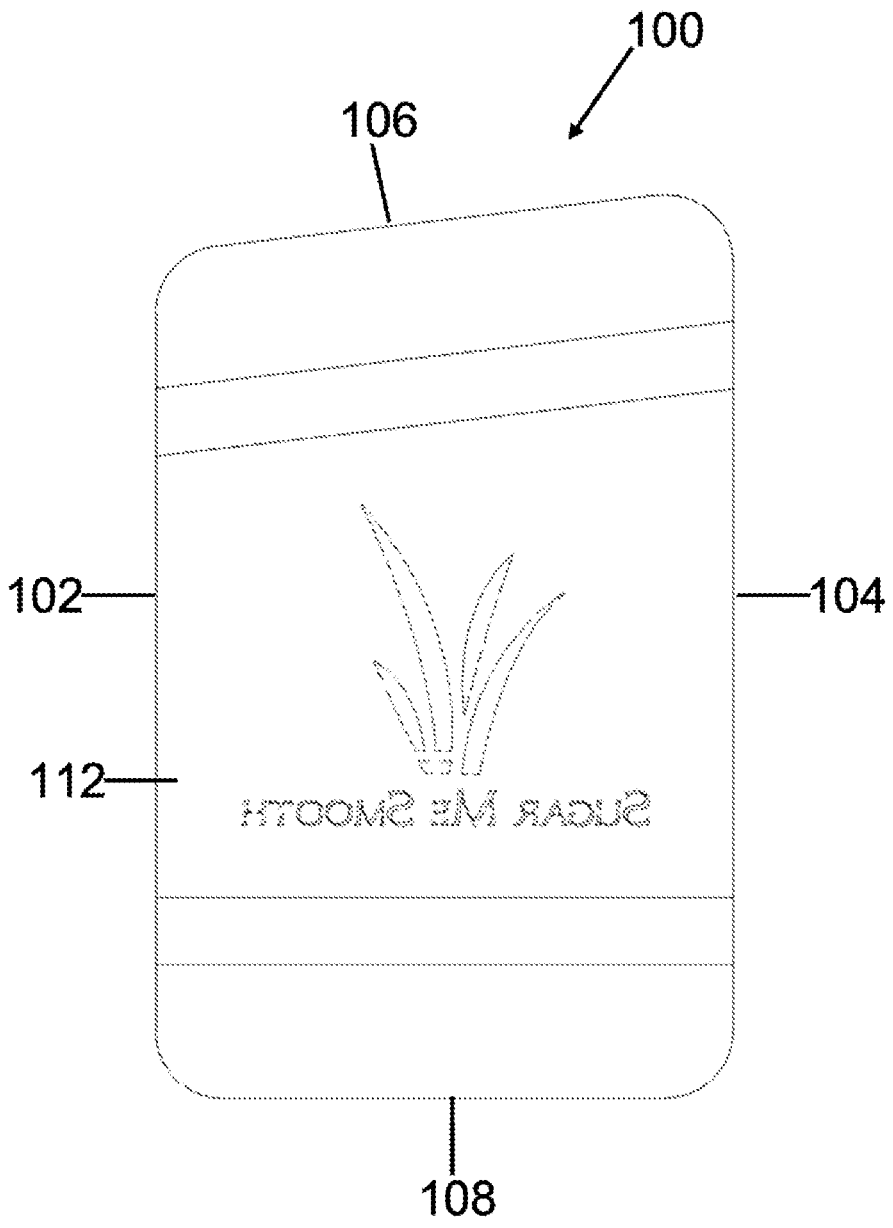
FIG. 3 is a plan view of one embodiment of a hand-held hair removal article in accordance with the teachings of the present disclosure.
Figure 4:
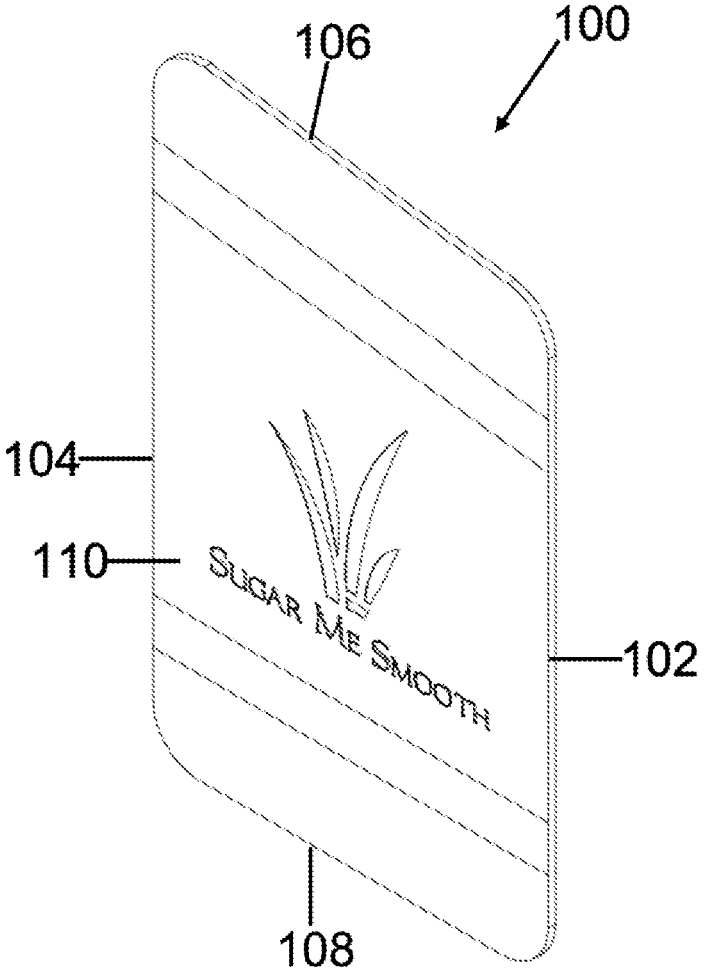
FIG. 4 is a perspective view of one embodiment of a hand-held hair removal article in accordance with the teachings of the present disclosure.

The following detailed description of the present invention references the accompanying drawing figures that illustrate specific embodiments in which the invention can be practiced. The embodiments are intended to describe aspects of the present invention in sufficient detail to enable those skilled in the art to practice the invention. Other embodiments can be utilized and changes can be made without departing from the spirit and scope of the present invention. The present invention is defined by the appended claims and, therefore, the description is not to be taken in a limiting sense and shall not limit the scope of equivalents to which such claims are entitled.

The present hand-held hair removal article aims to provide a more efficient article based on its design. The present article aims to provide a more ergonomically correct design to provide a more comfortable experience to avoid long-term injuries or exacerbate prior injuries to the wrist or hand of the user. The present article aims to provide a better user experience based on the exterior textures of the article, as well as an optional internal cavity to allow less slippage and better grippage. The present article aims to provide a shorter and easier learning curve in learning to properly use the reusable flexible article for hair removal with the hair removal compound. The present article aims to provide a more versatile article that can be used with either or both hands on larger areas of the body, as well as more constricted, hard to reach places on the body, such as that within the bikini area, both upper and lower portions, as well as that of the buttocks.

With these thoughts in mind, amongst others, aspects of the present disclosure were conceived and developed.

Aspects of the present disclosure may include, but are not limited to, a substantially planar hand-held hair removal article 100 comprising a first side 102, a second side 104, a top side 106, a bottom side 108, a top surface 110, and a bottom surface 112, the first side 102 comprising a first right angle 114 between the first side 102 and the bottom side 108 and an obtuse angle 120 between the top side 106 and the first side 102, the second side 104 comprising a second right angle 116 between the bottom side 108 and the second side 104 and an acute angle 118 between the second side 104 and the top side 106, the top surface 110 and the bottom surface 112 comprising a consistent thickness between the top surface 110 and the bottom surface 112, the angles between the first side 102, the bottom side 108, the second side 104, and the top side 106 being rounded, the hand-held hair removal article comprising a flexible material.

In certain instances, the first side 102 is approximately 3.15", the second side is approximately 3.40", and the bottom side is approximately 2.15".

In certain instances, the first side 102 is approximately 2.02", the second side 104 is approximately 2.15", and the bottom side 108 is approximately 1.14".

In certain instances, the thickness between the top surface 110 and the bottom surface 112 is approximately 0.04".

In certain instances, the hand-held hair removal article 100 comprises at least one cavity between the top surface 110 and the bottom surface 112.

In certain instances, the top surface 110 comprises one or more finishes on part or all of the top surface 110, including, but not limited to, a gloss, smooth, transparent, translucent, dimpled, rippled, depressed, matte, rough, or grip finish.

In certain instances, the bottom surface 112 comprises one or more finishes on part or all of the bottom surface 112, including, but not limited to, a gloss, smooth, transparent, translucent, dimpled, rippled, depressed, matte, rough, or grip finish.

In certain instances, the hand-held hair removal article 100 comprises symmetrical curvature throughout the top surface 110 and the bottom surface 112 for better grippability.

In certain instances, the hand-held hair removal article 100 comprises asymmetrical curvature throughout the top surface 110 and the bottom surface 112 for better grippability.

In certain instances, the top surface 110 is raised or lowered in one or more portions of the top surface 110.

In certain instances, the bottom surface 112 is raised or lowered in one or more portions of the bottom surface 112.

In certain instances, the hand-held hair removal article 100 comprises a material capable of flexing to scoop, apply and/or remove a volume of hair removal compound from a hair removal area.

In certain instances, the hand-held removal article 100 material comprises, but is not limited to, polycarbonate, polypropylene, polyethylene, or other similar plastic material or a combination thereof.

In certain instances, the hand-held removal article 100 comprises an ambidextrous design to be used by either a right hand or a left hand.

In certain instances, the hand-held removal article 100 comprises capabilities to be used at various angles and hand-held positions to scoop, apply and/or remove a volume of hair removal compound from a hair removal area.

In certain instances, the hand-held removal article 100 comprises, but is not limited to, scoop, apply and/or remove a volume of hair removal compound from a hair removal area with a first side 102, a second side 104, a top side 106, a bottom side 108, a top surface 110, or a bottom surface 112.

In certain instances, the hand-held removal article 100 comprises of one or more hand-held removal articles, such that multiple hand-held removal articles can be cut from the same material mold and disconnected at a later time. For example, during production, a hand-held removal article 100 would comprise of three separate hand-held removal articles that can be separated by methods of, but not limited to, breaking apart, snapping, bending, or another form of separation.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A hand-held hair removal article comprising:

a substantially planar hand-held substrate hair removal article comprising a first side, a second side, a top side, a bottom side, a top surface, and a bottom surface;

the first side comprising a first right angle between the bottom side and the first side and an obtuse angle between the first side and the top side;

the second side comprising an acute angle between the second side and the top side and a second right angle between the second side and the bottom side;

the top surface and the bottom surface comprising a consistent thickness between the top surface and the bottom surface;

the top surface comprising a gloss finish on part of the top surface and a rough finish on part of the top surface;

the bottom surface comprising a gloss finish on part of the bottom surface and a rough finish on part of the bottom surface;

the angles between the first side, the bottom side, the second side, and the top side being rounded;

the hand-held hair removal article comprising a flexible homogenous plastic material adapted to scoop, apply, or remove a volume of a hair removal compound from a hair removal area.

* * * * *